US005697832A

United States Patent [19]

Greenlaw et al.

[11] Patent Number: 5,697,832

[45] Date of Patent: Dec. 16, 1997

[54] VARIABLE SPEED BI-DIRECTIONAL PLANETARY GRINDING OR POLISHING APPARATUS

[75] Inventors: David Greenlaw, Milford, N.H.; William A. Hughes; Terry Hickman, both of Champaign, Ill.; John Berbaum, Monticello, Ill.; Clyde Marchand, Champaign, Ill.

[73] Assignee: Cerion Technologies, Inc., Champaign, Ill.

[21] Appl. No.: 544,720

[22] Filed: Oct. 18, 1995

[51] Int. Cl.[6] ..... B24B 7/22

[52] U.S. Cl. ..... 451/291; 451/290

[58] Field of Search ..... 451/291, 290, 451/287, 286, 285, 41

[56] References Cited

U.S. PATENT DOCUMENTS

| | | | |
|---|---|---|---|
| 1,541,001 | 6/1925 | Searles . | |
| 2,973,605 | 3/1961 | Carman et al. | 51/118 |
| 3,089,292 | 5/1963 | Hunt | 51/118 |
| 3,457,682 | 7/1969 | Boettcher et al. | 51/129 |
| 3,662,498 | 5/1972 | Caspers | 51/118 |
| 3,744,187 | 7/1973 | Lynah, Jr. et al. | 51/118 |
| 3,813,828 | 6/1974 | Bennett | 51/281 |
| 3,892,092 | 7/1975 | Keith, Jr. | 51/154 |
| 3,925,936 | 12/1975 | Orlov et al. | 51/118 |
| 4,369,603 | 1/1983 | Gebel et al. | 51/236 |
| 4,593,495 | 6/1986 | Kawakami et al. | 451/291 |
| 4,805,348 | 2/1989 | Arai et al. | 51/118 |
| 4,916,868 | 4/1990 | Wittstock | 51/281 |
| 4,962,616 | 10/1990 | Wittstock | 51/165 |
| 5,097,630 | 3/1992 | Maeda et al. | 51/50 |
| 5,187,901 | 2/1993 | Karlsrud | 51/132 |
| 5,197,230 | 3/1993 | Simpfendorfer et al. | 51/165.77 |
| 5,205,077 | 4/1993 | Wittstock | 51/165 |
| 5,274,960 | 1/1994 | Karlsrud | 51/109 |

FOREIGN PATENT DOCUMENTS

| | | | |
|---|---|---|---|
| 2006197 | 1/1977 | Japan | 451/291 |
| 1140960 | 6/1989 | Japan | 451/287 |
| 1295760 | 11/1989 | Japan | 451/291 |
| 2145253 | 6/1990 | Japan | 451/287 |

OTHER PUBLICATIONS

*Training Guide—Disk Polisher 9B–5SSG* Presented by SpeedFam Electronics Equipment Group, Chandler, Arizona, Nov. 8, 1994.

*Primary Examiner*—Robert A. Rose

*Attorney, Agent, or Firm*—Testa, Hurwitz & Thibeault, LLP

[57] ABSTRACT

This invention relates to a planetary grinding or polishing machine wherein the outer ring gear, the upper platen, and the lower platen are independently rotatable in the clockwise or counterclockwise directions at variable speeds. Such grinding or polishing is especially useful in high precision finishing of aluminum, nickel plated, and ceramic substrates where uniform and non-uniform surface finishes are required from surface-to-surface in the workpiece.

7 Claims, 6 Drawing Sheets

VARIABLE SPEED BI-DIRECTIONAL PLANETARY GRINDING OR POLISHING APPARATUS

BACKGROUND OF THE INVENTION

1. Field of the Invention

This invention relates to a machine for simultaneously grinding or polishing the surfaces of one or more workpieces. More particularly, the invention relates to a planetary grinding or polishing machine wherein the outer ring gear, the upper platen, and the lower platen are independently rotatable in the clockwise or counterclockwise directions at variable speeds. Such grinding or polishing is especially useful in high precision finishing of aluminum and nickel plated substrates as well as ceramic substrates, and particularly where uniform and non-uniform surface finishes are required on a workpiece.

2. Description of the Related Art

Various machines exist in the prior art for simultaneously finishing the surfaces of a workpiece. These prior art devices include circumferential pattern finishing machines; dual lapping, honing, and grinding machines; double sided finishing machines; and planetary lapping machines. Planetary machines may be particularly useful in finishing aluminum and silicon substrates.

Planetary machines typically include an upper and lower finishing plate, a workpiece holder, a sun gear, an outer ring gear, and a system for driving selected components. The sun gear generally is concentric with, and located within the upper and lower platens. The workpieces rotate around the sun gear when driven by either the outer ring gear or sun gear. Planetary machines are desirable not only because they simultaneously finish opposite sides of a workpiece, but because their planetary configuration provides varied polishing or grinding over a surface to achieve a uniform finish.

Generally prior art planetary machines are configured so that the rotational speed and direction of moving components such as the upper and lower finishing platens, the outer ring gear, and the sun gear are interdependent. That is, they are capable of bi-directional rotation at variable speeds, but changing the speed of one component affects the speed of another. U.S. Pat. No. 5,205,077 issued to Wittstock describes such a machine.

Wittstock discloses a machine wherein a computer is used to calculate the speed of various rotatable components such as the inner gear (sun gear), the upper working disk, and the lower working disk. For example, Wittstock discloses that if the rotational speed of the planetary gear member is preselected, the computer calculates the desired drive speed of the inner gear member. Wittstock further teaches preselection of the rotational speed of the planetary gear member and the difference between the speeds of the workpiece and the working disks. When any one of these parameters is changed, the other parameters will be automatically recalculated and reset in accordance with certain mathematical formulas.

Such machines do not permit independently varying the speed and rotational direction of the upper and lower working disks and the outer gear. Hence, there exists a need in the industry to develop a planetary grinding or polishing machine which would permit the upper and lower platens and the outer ring gear to rotate independently in either the clockwise or counterclockwise direction at variable speeds without affecting the operating parameters of the other two components. Allowing the ring gear to rotate independently permits greater control over the speed and rotation of the carrier gears and the grinding or polishing pattern formed on the finished surface.

It is therefore an object of this invention to provide a planetary grinding or polishing machine which permits the independent rotation of the upper and lower platens and the outer ring gear in either the clockwise or counterclockwise directions.

It is another object of this invention to provide a planetary grinding or polishing machine which permits the upper and lower platens and the outer ring gear to operate independently at variable speeds.

It is still another object of this invention to provide a machine which permits the speed and direction of the upper platen, lower platen, and ring gear to be varied by manipulating control switches located on an operator control panel.

It is a further object of this invention to provide a planetary grinding or polishing machine which reduces cycle finishing time.

It is also an object of this invention to provide a planetary grinding or polishing machine which provides enhanced control over surface finishing parameters.

It is a further object of this invention to provide a planetary grinding or polishing machine which permits simultaneously machining two sides of a workpiece to obtain non-uniform surface finishes on opposite sides of the workpiece.

SUMMARY OF THE INVENTION

The previously described objects of the present invention are met by providing a planetary grinding or polishing apparatus which simultaneously finishes the surfaces of one or more workpieces, and includes an upper platen, a lower platen, and an outer ring gear which are independently rotatable in the clockwise or counterclockwise directions at variable speeds.

The machine also includes a rotatable sun gear placed at the center of the planetary gear system. The sun gear may be detachably connected to either the upper or lower platen. Consequently, the speed and rotational direction of the sun gear depends upon the speed and rotational direction of the upper or lower platen.

Carrier gears for holding workpieces are positioned on the top surface of the lower platen, and are annularly spaced around the sun gear. The carrier gears include slots for holding one or more workpieces to be machined. The carrier gears also include an annular outer row of teeth which mesh with an annular outer row of teeth on the sun gear, and an inner annular row of teeth on the outer ring gear. The carrier gears therefore are driven by the sun gear and the outer ring gear.

The outer ring gear drives the carrier gears in an orbital path around the sun gear. The outer ring gear is connected to an independent drive system which permits it to rotate in the clockwise or counterclockwise direction at variable speeds. The means for driving the ring gear may include a reversible variable speed motor connected to a drive shaft and gear train system.

The upper platen is concentric with, and parallel to, the ring gear. The upper platen finishes one surface of the workpieces using an abrasive such as grinding stones or pads and/or slurry. The upper platen is connected to an independent drive system which permits it to rotate in the clockwise or counterclockwise direction at variable speeds. The upper platen drive system may include a motor pulley drive system, wherein the motor is a reversible variable speed electric motor.

The lower platen is concentric with, and parallel to, the upper platen. The lower platen also includes abrasives for finishing one surface of the workpieces. As previously described, the abrasives can be grinding stones or pads and/or slurry. The lower platen also includes a separate drive system for independently rotating it in the clockwise or counterclockwise direction at variable speeds. The means for driving the lower platen may include a motor pulley drive system powered by a reversible variable speed electric motor.

The machine is designed to allow an operator to select certain operating parameters. For instance, an operator can select the rotational direction and speed of the upper platen, lower platen, and outer ring gear. The operator also may select the machine operating parameters such that a different surface finish may be achieved simultaneously on each machined surface during a single finishing cycle. The operator can select the desired operating and variable operating parameters by adjusting the appropriate machine selection switches. For example, the operator can adjust the speed and rotational direction of the ring gear by turning the direction switch to clockwise or counterclockwise, and the speed control switch to the desired setting. The machine also may be programmed for specific finishing cycle and rinse cycle times by programming the cycle timers. The finishing cycle begins by pressing the cycle start button to lower the top platen into the polishing or grinding position. At the end of the cycle, the upper platen raises and the machine can be unloaded.

The present invention is further described with reference to the drawings.

DETAILED DESCRIPTION

Figure 1:
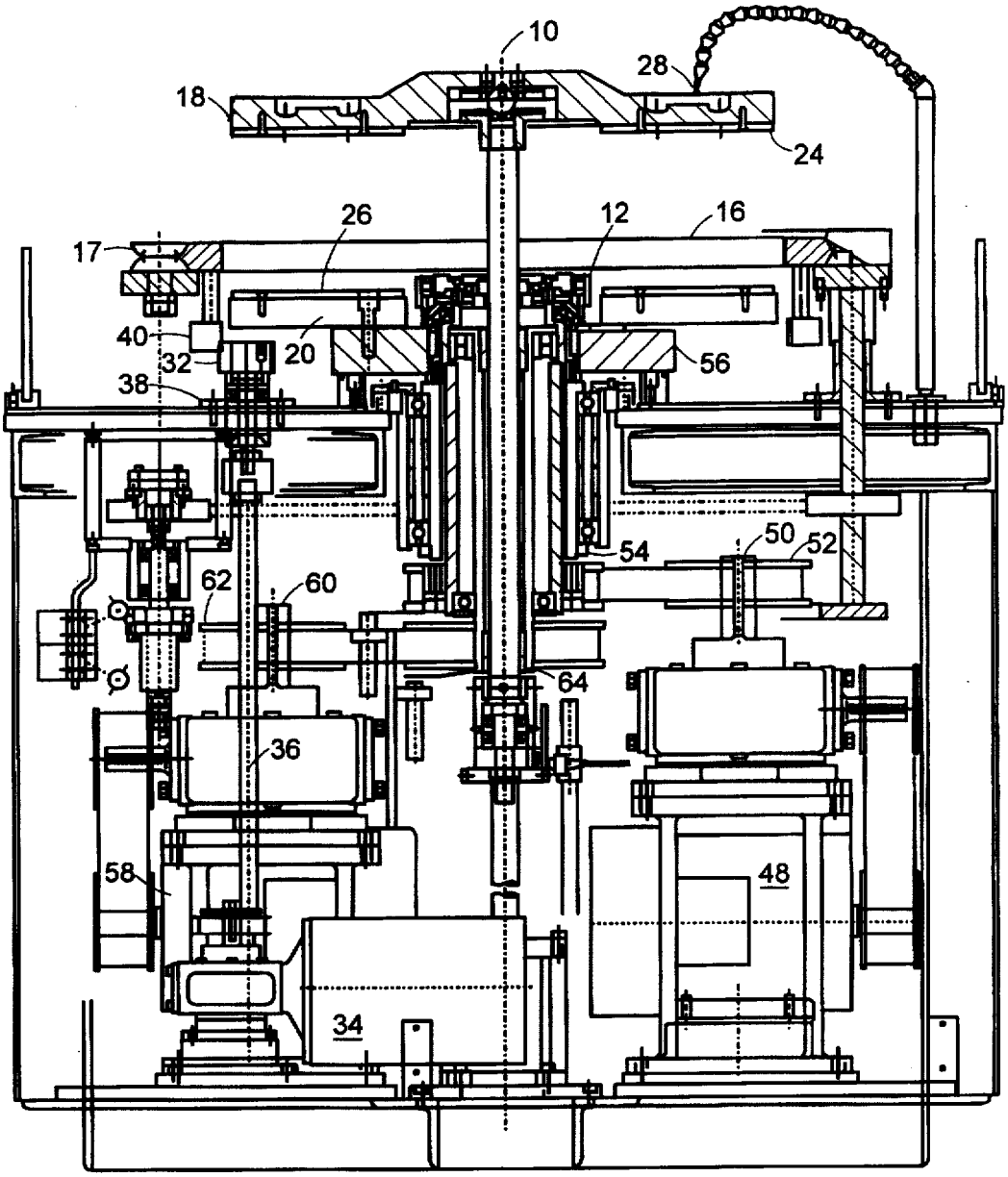
FIG. 1 is a front elevational view in cross-section of a variable speed bi-directional grinding or polishing apparatus formed accordance with the teachings of this invention.

This invention relates to a planetary grinding or polishing machine which simultaneously finishes two sides of one or more workpieces by applying relatively low pressure to the workpiece during the grinding or polishing cycle. The grinding or polishing machine can be used as either a soft stone grinder or a slurry (free abrasive) polisher. Conversion from one operation to the other is a simple procedure. The machine includes one or more workpiece carrier gears, a sun gear, a rotatable outer ring gear, rotatable variable speed upper and lower platens, and separate means for driving the ring gear, the upper platen, and lower platen.

The planetary grinding and polishing apparatus of the present invention is designed to provide increased variability and greater user control over the rotating components. The ring gear, upper platen and lower platen are independently driven by programmable logic controlled variable frequency drives. The separate drive systems permit adjustment of the speed and/or rotational direction of a single component without affecting the speed or rotational direction of another independently driven component. For instance, adjusting the speed and rotational direction of the lower platen does not affect the speed and rotational direction ring gear or the upper platen.

The sun gear may be driven by either the upper or lower platen, depending upon operator selection. The sun gear can be fastened to either the upper or lower platen by a specially designed locking device. The locking device prevents inadvertently attaching the sun gear simultaneously to both the upper and lower platen. The locking device includes a locking ring which includes two pairs of holes. One pair of holes is located on the locking ring near the center of the machine, and the other pair is located on the locking ring away from the center of the machine. To lock the sun gear to the upper platen, a pair of locking pins are screwed into the holes closest to the center of the machine. To lock the sun gear to the lower platen, the locking pins are threaded into the holes in the locking ring located farthest away from the center of the machine. Regardless of whether the sun gear is attached to the upper or lower platen, the sun gear causes the workpiece carrier gears to rotate about their center axis.

The workpiece carrier gears are placed annularly around the sun gear, and they each hold one or more workpieces. A rotatable variable speed outer ring gear drives the carriers in a planetary motion around the sun gear. The upper and lower platens are placed parallel to, and above and below, the carrier gears. The upper and lower platens can include abrasives, or they may be configured to receive and polish a workpiece using a slurry.

In an embodiment of the invention, converting the machine from one mode, polishing or grinding, to the other can be completed by two technicians in about one hour. For example, to convert the machine from a polisher to a grinder (1) turn the selector switch from "Polish" to "Grind"; (2) remove the polish platens; (3) disconnect the slurry feed lines; (4) flush the coolant delivery lines with water; (5) connect the coolant supply; (6) mount the grinding stones; (7) dress the grinding stones; and (8) load the workpieces into the machine.

Figure 2:
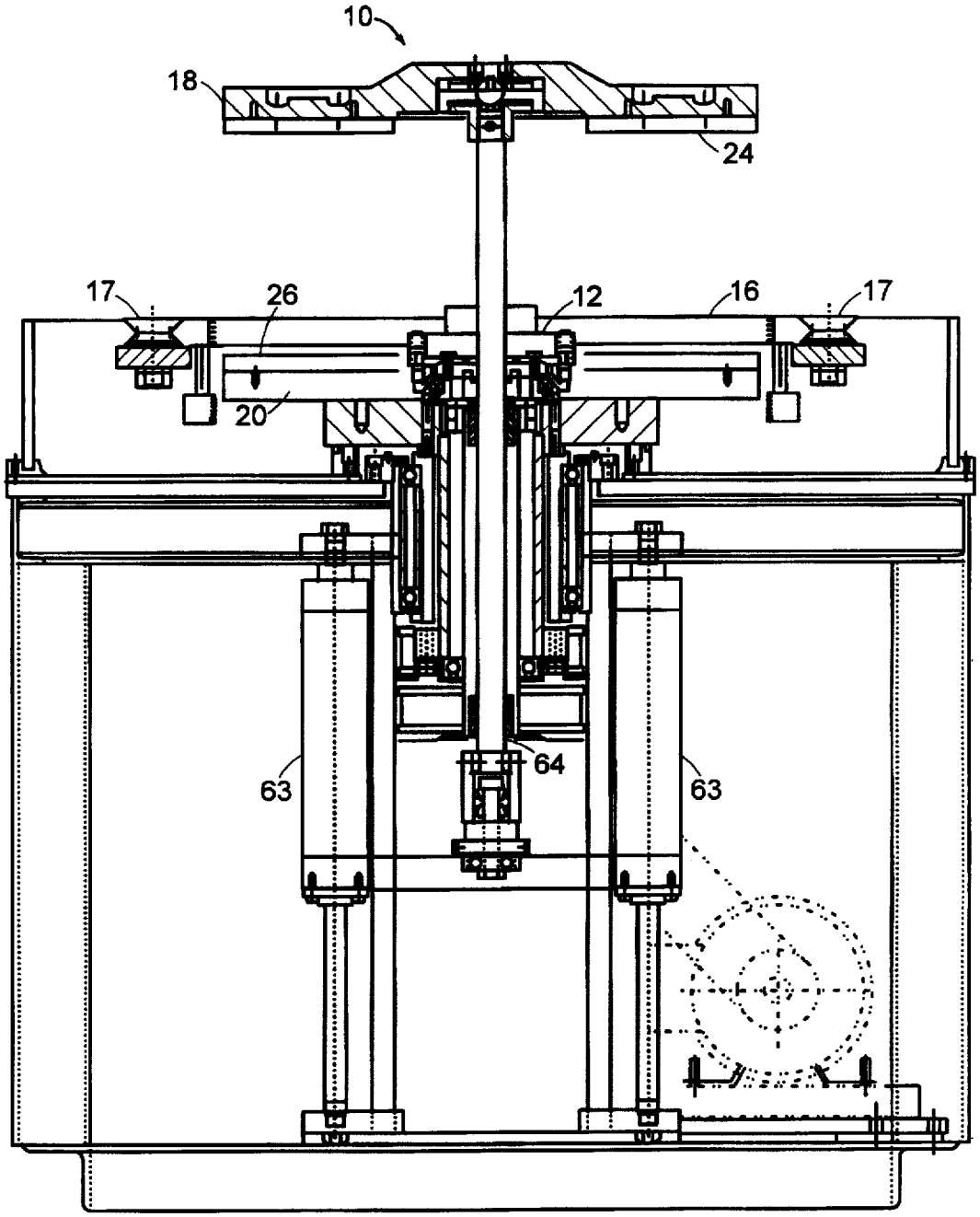
FIG. 2 is a side elevational view in cross-section of the apparatus of FIG. 1.
Figure 3:
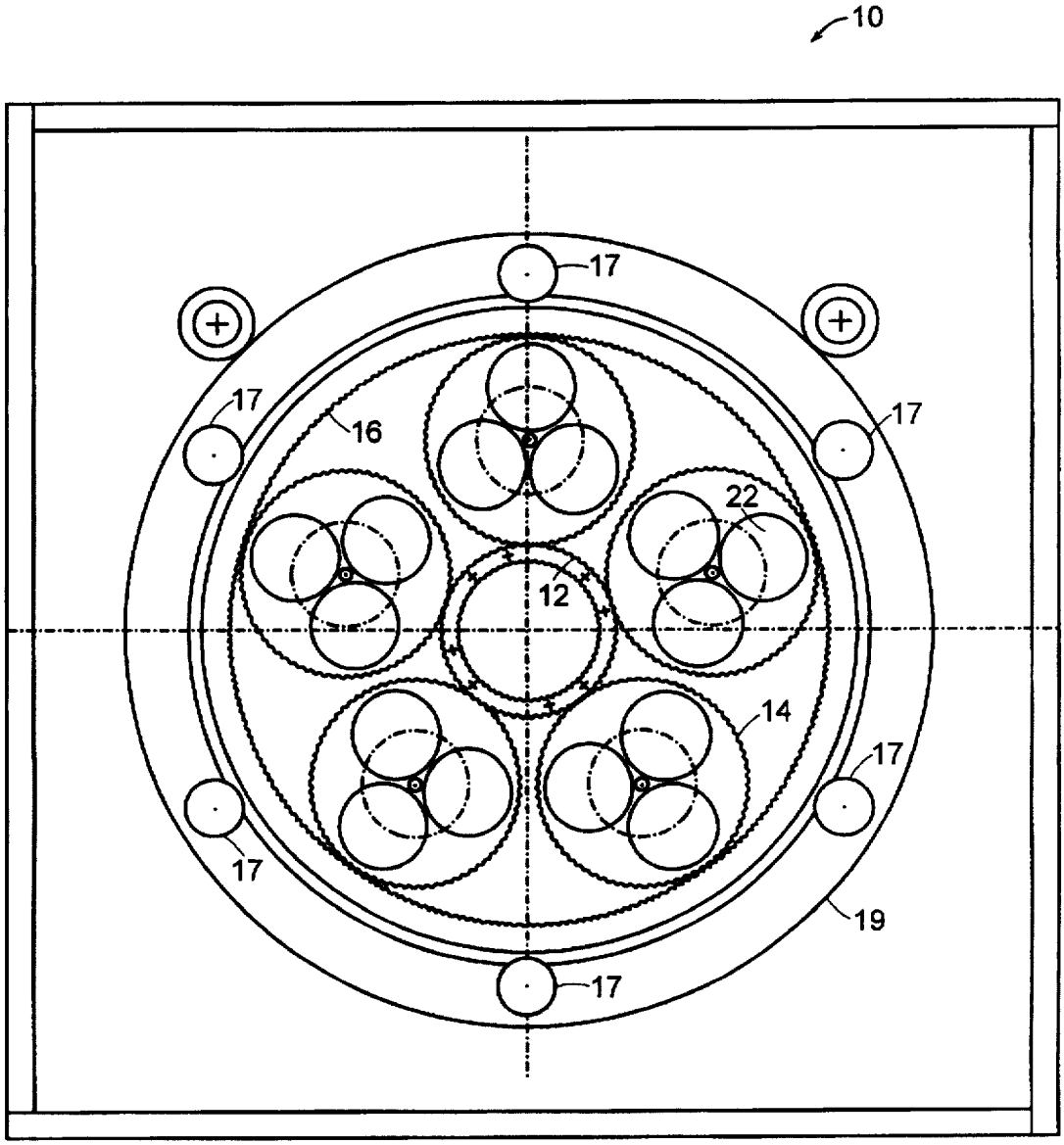
FIG. 3 is a top plan view of the variable speed bi-directional grinding or polishing apparatus of FIG. 1.

The machine will be better understood by reference to the drawings. FIGS. 1, 2 and 3 show an exemplary embodiment of the machine 10. The machine 10 includes a rotatable sun gear 12, a plurality of rotatable carrier gears 14, a rotatable variable speed outer ring gear 16, a rotatable variable speed upper platen 18, and a rotatable variable speed lower platen 20.

The sun gear 12 is located at the center of the planetary gear system formed in the machine 10. The assembly which supports the sun gear 12 is located in the center of the lower platen 20. This assembly is bolted to the main spindle assembly, but the sun gear 12 itself is mounted on a thrust bearing which permits it to freely rotate in either a clockwise or counterclockwise direction. The sun gear 12 can be connected to, and driven by, either the upper or lower platens 18 or 20. Consequently, the rotational direction and speed of the sun gear 12 depends upon the direction and speed of the platen 18 or 20 to which it is attached. The sun gear 12 is fastened to either the upper or lower platen 18 or 20 by a specially designed locking device 21 (shown in FIG. 4) which prevents simultaneously fastening the sun gear 12 to both the upper and lower platens 18 and 20.

Figure 4:
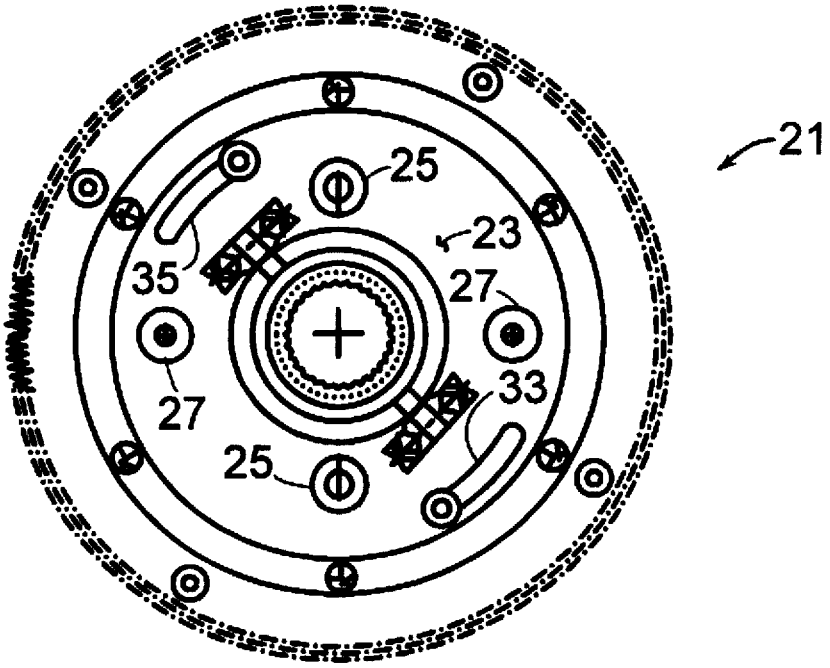
FIG. 4 is a top view of the locking mechanism used to secure the sun gear to either the upper or lower platen.

The locking device 21 is located inside the sun gear 12. FIG. 4 shows a top view of the locking device 21. The locking device includes a locking ring 23. The locking ring 23 defines two pairs of threaded holes 25 and 27 and two slots 33 and 35. Threaded holes 25 are spaced 180 degrees apart, and are located near the center of the machine 10. Threaded holes 27 also are spaced 180 degrees apart, but are located further away from the machine 10 center than threaded holes 25. Threaded fasteners (not shown) such as pins are received in the holes 25 or 27 to lock the sun gear 12 respectively to the upper or lower platen 18 or 20. The slots 33 and 35 permit the locking ring 23 to rotate approximately 30 degrees in the clockwise or counterclockwise direction.

The locking device 21 further includes upper platen 18 and lower platen 20 mating parts (not shown). Each mating part is spaced apart from the locking ring 23, and defines a pair of mating holes (not shown). When the locking ring 23 is rotated about slots 33 and 35, the mating holes become aligned with either holes 25 or 27. For instance, when the locking ring 23 is rotated in the counterclockwise direction, holes 25 are aligned with the mating holes defined by the lower platen 20 mating part. Fasteners are screwed through holes 25 and into the pair of mating holes defined by the lower platen 20 mating part.

To drive the sun gear 12 with the top platen 18, verify that the fasteners are screwed into the threaded holes 25. If the fasteners are in the holes 25, the sun gear 12 is already being driven by the top platen 18. If not, unscrew the fasteners until they are almost out of the locking ring 23. Using the fasteners, rotate the locking ring 23 counterclockwise about slots 33 and 35. When the locking ring 23 is rotated to the proper position, the fasteners line-up with the mating holes defined by the upper platen 18 mating part. To verify the alignment between the fasteners and the mating holes defined by the upper platen 18 mating part, look down into one of the tapped holes 25 or 27 and rotate the sun gear until the mating holes defined by the upper platen 18 mating part are visible.

Once the fasteners and the holes defined by the upper platen mating part are in alignment, remove the fasteners from holes 27 and screw them into the holes 25. The fasteners should be threaded into the locking ring 23 such that their distal ends are flush with the surface of the locking ring 23. If this fit cannot be achieved, check the alignment between the mating holes defined by the upper platen 18 mating part and the fasteners. If misalignment occurs, the process must be repeated.

Repeat the described process to drive the sun gear 12 with the bottom platen 20, except rotate the locking ring 23 clockwise about slots 33 and 35 until it stops. Align the fasteners with the mating holes defined by the lower platen 20 mating part. Remove the fasteners from holes 25 and screw them into holes 27 and the mating holes defined by the lower platen 20 mating part.

Regardless of the platen 18 or 20 used to drive the sun gear 12, the sun gear 12 causes the carrier gears 14 to rotate about their center axis. As shown in FIG. 3, the carrier gears 14 are positioned on the lower platen 20, and are annularly spaced around the sun gear 12. The carrier gears 14 move in a planetary motion around the sun gear 12. The carrier gears 14 freely rotate between the sun gear 12 and the outer ring gear 16. The rotational direction and speed of the carrier gears 14 depends on the direction and speed of the sun gear 12 and the ring gear 16.

The carrier gears 14 may be formed from a fiber glass material. However, a variety of materials having various thicknesses and configurations can be used to form the carrier gears 14. For example, steel may be used to construct the carrier gears 14. The carrier gears 14 include slots for holding the workpieces 22. They also include an annular outer row of teeth which mesh with an annular outer row of teeth on the sun gear 12, and an inner annular row of teeth on the outer ring gear 16. In one embodiment of the invention, the carrier gears 14 have 108 teeth.

The ring gear 16 drives the carrier gears 14 in an orbital motion around the sun gear 12, which is concentric with the ring gear 16. The ring gear 16 may be mounted to V-groove rollers 17 which is attached to a V-groove mounting plate 19. The V-groove mounting plate 19 is movably attached to the machine 10 above the lower platen 20, and may be adjusted manually to permit vertical movement of the ring gear 16 relative to the lower platen 20. The ring gear 16 also is connected to an independent drive system 32 which allows the ring gear to rotate in the clockwise and counterclockwise directions at variable speeds. Independently controlling the rotation and speed of the ring gear 16 permits greater control over the speed of the carrier gears 14. This results in greater control over the speed at which the abrasives contact the workpieces, and therefore greater control over the surface finish of the finished workpieces.

The ring gear 16 is capable of rotational speeds ranging from 0–45 RPMs in both directions. As shown in FIG. 1, the ring gear drive system 32 includes a reversible variable speed drive motor 34 connected to a drive shaft 36. The drive shaft 36 is connected to a first gear system 38 which drives a second gear system 40 connected to the outer ring gear 16. Other drive systems such as direct drives using DC motors or transmission drives can be used to rotate the ring gear 16.

The ring gear 16 holds the carrier gears 14 in position on the lower platen 20. The lower platen 20 is concentric with the ring gear 16, and includes a separate, independent pulley drive system 50. The lower platen 20 is affixed to its drive system 50 through a drive shaft 54.

As shown in FIG. 1, the drive system controlling the motion of the lower platen 20 includes a variable speed reversible motor 48 connected to the pulley drive system 50. The pulley 52 is connected to a drive shaft 54 which drives a hub gear 56 which is connected to the lower platen 20. The lower platen 20 may be capable of rotational speeds in both directions which range from 0–60 RPMs.

Figure 6:
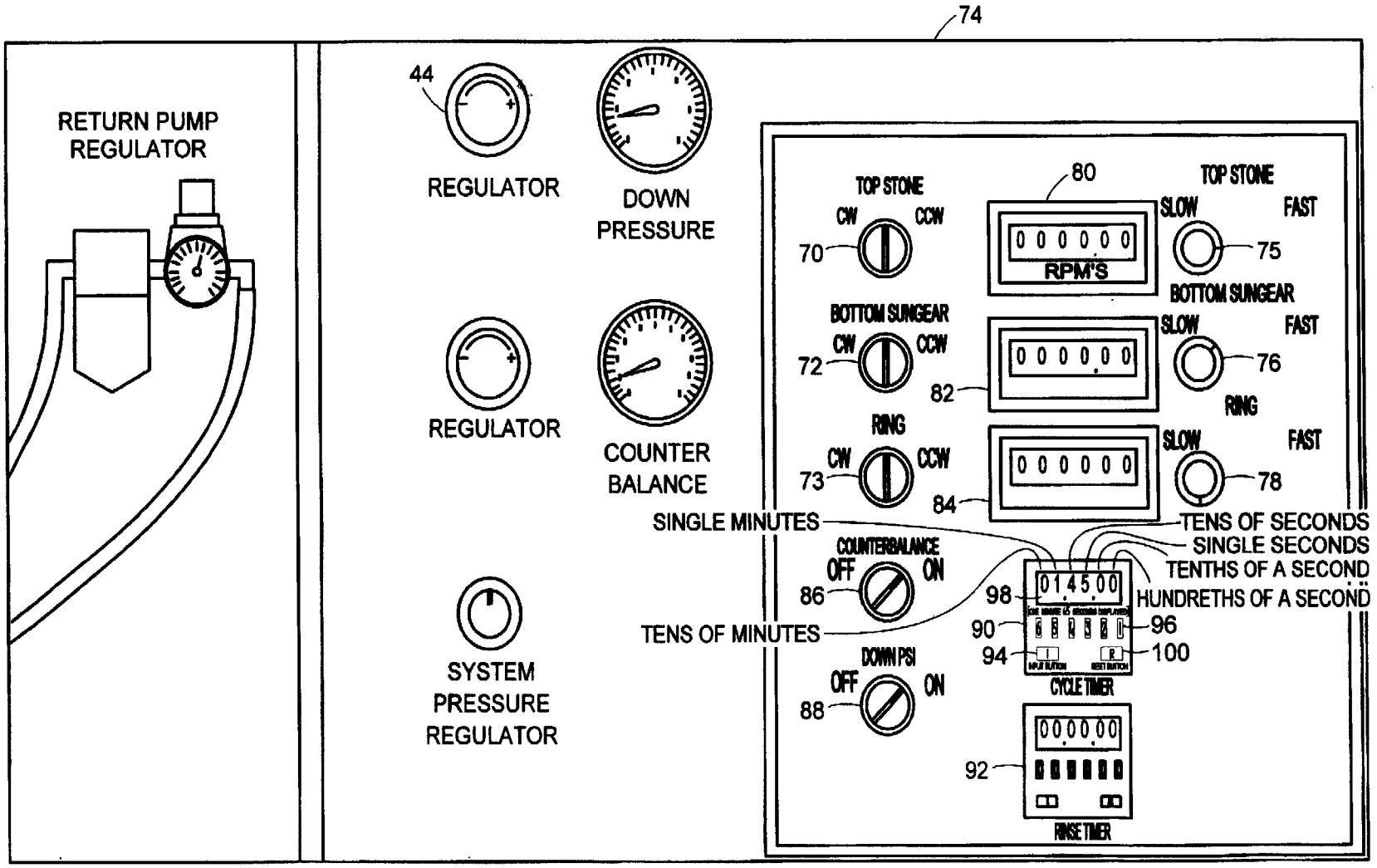
FIG. 6 is a front elevational view of the variable control panel of the apparatus of FIG. 1.

The upper platen 18, concentric with and parallel to the lower platen 20, is connected to a drive shaft 64 by a universal joint. The universal joint allows the upper platen 18 to float or self-align with the lower platen 20. During idle periods, the upper platen is suspended above the carrier gears 14 by air pressure acting on one or more cylinders 63 connected to the base of the drive shaft 64. To lower the upper platen 18 to the machining position, simply release the pressure on the shaft 64. The pressure release is controlled by a pneumatic solenoid (not shown) and monitored by the pressure regulator gauge 44 shown in FIG. 6.

A reversible variable speed drive system 60 imparts rotational motion to the upper platen 18. The upper platen 18 is configured to rotate in the clockwise or counterclockwise directions at speeds which may range from 0–60 RPMs. The drive system 60 includes a motor 58 connected to the pulley drive system 60. Pulley 62 is connected to a drive shaft 64 which is coupled to the upper platen 18. Of course, other drive systems as previously described may be used to power the upper platen 18.

Both platens 18 and 20 include workpiece finishing surfaces 24 and 26, and may include a set of abrasives or polishing pads attached to these surfaces. The workpiece finishing surfaces 24 and 26 are brought into contact with the workpiece 22 to achieve simultaneous grinding or polishing of the workpiece surfaces. The platens 18 and 20 are independently rotated against the workpieces 22 to complete the finishing process.

Finishing of the workpiece 22 is accomplished by applying air pressure to the top of the air cylinders 63 connected to the drive shaft 64. This air pressure creates a downward force on the upper platen 18 to hold it in contact with the workpieces 22. The rate of removing material from the workpieces 22 can be adjusted by varying the amount of air pressure applied to the cylinders 63.

As the performance of a grinding wheel begins to deteriorate, the decline in material removal rate can be compensated for by increasing the air pressure on the cylinders 63. In an exemplary embodiment of this invention, a downward force ranging from 0.8 PSI to 2.28 PSI for 95 mm aluminum substrates is possible by adjusting the down pressure regulator over a range from 1 to 30 pounds. The material removal rate, rate for finishing the workpiece 22, can be maintained by adjusting the amount of air pressure applied on the cylinders 63.

Figure 5:
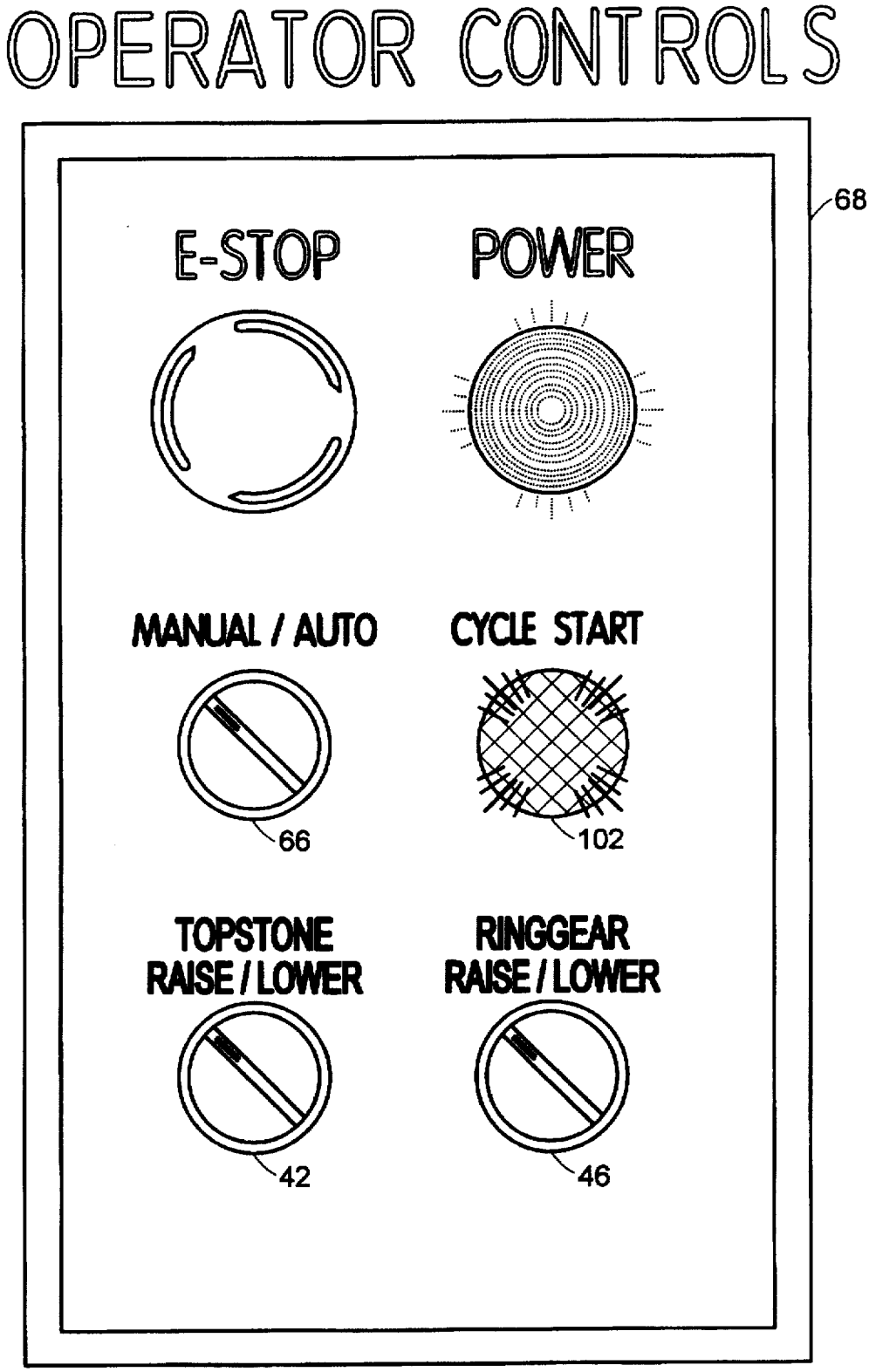
FIG. 5 is a front elevational view of the operator control panel of the apparatus of FIG. 1.

As shown in FIG. 5, a feature of an embodiment of the present invention is the ability to run the machine 10 in a manual operating mode. The manual mode allows an operator to select the desired operating parameters using the selection switches shown in FIG. 6. An operator also can examine the impact of a single variable or multiple variables on machine 10 performance. The manual mode feature thus allows adjustment of the machine 10 parameters to determine the optimum operating conditions for a particular application or material.

Another feature of an embodiment of the present invention is the automatic operating mode. Unlike other planetary grinding and polishing machines, there is no need to raise or lower the upper platen 18 manually. The present invention merely requires the operator to select the appropriate machine parameters, load the workpieces 22 into the carrier gears 14, and press the start cycle button 102. The upper platen 18 will drop down to the machining position, and will raise up when the cycle is complete.

Still, another feature of an embodiment of the machine 10 is the existence of a default or preset cycle. The default cycle controls the rotational direction and speed of the moving components.

Regardless of the chosen operating mode, the finishing process begins by pressing the cycle start button 102. As previously described, this causes the lowering of the upper platen 18 from its suspended position above the workpieces 22. Once the operator pushes the cycle start button, there is a slight delay before air pressure is applied to the air cylinders 63. This delay permits the machine 10 to ramp-up to speed without applying pressure on the workpieces 22. Likewise, the machine 10 releases the pressure on the workpieces 22 during the rinse and deceleration portions of the finishing cycle. Relieving the pressure on the workpieces 22 during these stages of the finishing cycle eliminates the shock and stress that may be imparted to the workpieces 22 and the drive motors when the machine 10 goes from a dead stop to working speeds and pressures.

The machine 10 will be better understood by reference to the operation of the default cycle. The default cycle begins by loading the workpieces 22 into the carriers 14, and selecting finishing and rinse cycle times. The machining finishing and rinse cycle times are selected by programming the desired times into the finishing cycle timer 90 and rinse cycle timer 92 (shown in FIG. 6). Preferred finishing cycle times are 4–6 minutes for rough finishing of aluminum substrates and 2–4 minutes for final finishing of these workpieces. A preferred cycle time of 6–10 minutes is used for polishing of nickel substrates. Rinse cycle times vary depending upon the operation being performed. For instance, a rinse time ranging from 10–20 seconds can be used during a polishing operation.

The cycle timers 90 and 92 are set by holding down the input button 94 and pressing the appropriate timer adjust buttons 96 (i.e., minutes or seconds) on the timing panel 98 to adjust it to the desired time. By releasing the timer adjust buttons 96 and the timer input button 94 stores the set time. The timer is again reset by pressing the timer reset button 100.

During the finishing process, the sun gear 12 is attached to the lower platen 20. The lower platen 20 and sun gear 12 rotate in the clockwise direction at 45 RPMs. The outer ring gear 16 also rotates in the clockwise direction at a speed of 17 RPMs. The upper platen 18 rotates in the counterclockwise direction at 15 RPMs. This set-up causes the carrier gears 14 to make one complete orbit around the sun gear 12, and one complete rotation about their own central axis. At the end of the cycle, the workpieces 22 are unloaded from the carrier and the steps repeated for subsequent finishing cycles.

In the default mode, the machine 10 is set-up to run with several preset operating parameters. For example, the manual/auto switch 66 on the operator control panel 68 is placed in the "auto" position (see FIG. 5), and the ring gear raise/lower switch 46 is set in the neutral position (straight up and down). The upper platen control 42 is set to the "Lower" position, and the counterbalance pressure (pressure on the drive shaft 64) is set at 10 PSI. This pressure represents the true weight of the upper platen 18 and shaft 64, and is the preferred counterbalance pressure. Depending on the specific operation, the counterbalance pressure may be adjusted to achieve the desired results. The variable control panel 74 settings for the upper platen 18, lower platen 20, and outer ring gear 16 are set in the neutral position, and the counterbalance 86 and down pressure 88 switches are in the "off" position.

To operate the machine in a mode other than the default mode, the settings on the operator control panel 68 shown in FIG. 5 remain unchanged. The settings on the variable control panel 74 shown in FIG. 6, however, are adjusted to achieve the desired operating parameters. Any of the variable parameter settings may be changed by turning the selection switch to the desired position. For example, to adjust the speeds of the ring gear 16 and the upper and lower platens 18 and 20, turn the manual/auto switch 66 to the manual mode, and turn the potentiometers 75, 76, and 78 clockwise to increase speed or counterclockwise to decrease speed. The desired speed may be achieved by monitoring the RPM of the desired component using RPM gauges 80, 82, or 84. It also is possible to adjust the speeds of these components during the automatic cycle by turning the potentiometers 75, 76, and 78 clockwise to increase the speed or counterclockwise to decrease the speed during the cycle.

The rotational direction of the upper platen 18, lower platen 20, and the outer ring gear 16 may be adjusted by placing the rotational selection switches 70, 72, and 73 in either the clockwise or counterclockwise position. To return to the default mode for any of the components, simply return the parameter selection switches back to their neutral position.

While the apparatus of this invention has been described in connection with specific embodiments, it should be understood that numerous modifications in dimensions, materials and/or techniques could be made by persons of ordinary skill in this art without departing from the scope of this invention. Accordingly, the foregoing description is intended to be merely illustrative and is not limiting. The scope of the invention as claimed should be understood to include all those alternatives and modifications which the above specification and drawings would suggest or which would readily occur or be apparent to one skilled in the art upon study of the same.

What is claimed:

1. A machine for simultaneously finishing the surfaces of one or more workpieces, comprising:

a sun gear;

one or more workpiece carrier gears for holding one or more workpieces, wherein the workpiece carrier gears are placed around the sun gear;

a bi-directionally rotatable, variable speed outer ring gear which drives the carrier gears in an orbital path around the sun gear;

a bi-directionally rotatable, variable speed upper platen placed above the carrier gear for finishing one surface of the workpieces;

a bi-directionally rotatable, variable speed lower platen placed below the carrier gear for finishing another surface of the workpieces;

means for separately and independently driving the outer ring gear;

means for separately and independently driving the upper platen; and means for separately and independently driving the lower platen a locking device which fastens the sun gear to either the upper or lower platen, the locking device comprising:

a locking ring located on the sun gear and defining two pairs of holes, the locking ring further defining two slots about which the locking ring rotates in either the clockwise or counterclockwise direction;

one or more fasteners received in one pair of the holes defined by the locking ring; and a first and second mating part spaced apart from the locking ring and defining a pair of mating holes for receiving the fasteners.

2. The machine defined in claim 1 wherein the first mating part is attached to the upper platen, and the second mating part is attached to the lower platen.

3. A machine for simultaneously finishing the surfaces of one or more workpieces, comprising:

a sun gear;

one or more workpiece carrier gears for holding one or more workpieces, wherein the workpiece carrier gears are placed around the sun gear;

a bi-directionally rotatable, variable speed outer ring gear which drives the carrier gears in an orbital path around the sun gear;

a bi-directionally rotatable, variable speed upper platen placed above the carrier gears for finishing one surface of the workpieces;

a bi-directionally rotatable, variable speed lower platen placed below the carrier gears for finishing another surface of the workpieces;

a locking device for alternatively fastening the sun gear to either the upper or lower platen, the locking device comprising:

a locking ring located on the sun gear and defining two pairs of holes, the locking ring further defining two slots about which the locking ring rotates in either the clockwise or counterclockwise direction;

one or more fasteners received in one pair of the holes defined by the locking ring; and a first and second mating part spaced apart from the locking ring and defining a pair of mating holes for receiving the fasteners;

means for separately and independently driving the outer ring gear;

means for separately and independently driving the upper platen; and means for separately and independently driving the lower platen.

4. The machine defined in claim 3 wherein the first mating part is attached to the upper platen, and the second mating part is attached to the lower platen.

5. The machine defined in claim 3, wherein the means for driving the upper platen includes a motor pulley drive system attached to the upper platen for rotating the upper platen in the clockwise or counterclockwise direction at variable speeds.

6. The machine defined in claim 3, wherein the means for driving the lower platen includes a motor pulley drive system attached to the lower platen for rotating the lower platen in the clockwise or counterclockwise direction at variable speeds.

7. The machine defined in claims 3, wherein the means for driving the outer ring gear is a drive shaft connected to the outer ring gear for rotating the outer ring gear in the clockwise or counterclockwise direction at variable speeds.

* * * * *